United States Patent [19]

DeFord

[11] 4,353,281

[45] Oct. 12, 1982

[54] SPLIT E FLUTE AND SPLIT E MECHANISM THEREFOR

[75] Inventor: Emerson L. DeFord, Elkhart, Ind.

[73] Assignee: Emerson Musical Instruments Inc., Elkhart, Ind.

[21] Appl. No.: 229,757

[22] Filed: Jan. 29, 1981

[51] Int. Cl.[3] ..... G10D 7/02; G10D 9/04

[52] U.S. Cl. ..... 84/384; 84/380 R

[58] Field of Search ..... 84/380 R, 382, 384, 84/385 R

[56] References Cited

U.S. PATENT DOCUMENTS 901,913 10/1908 Julliot ..... 84/384

2,051,176 8/1936 Powell ..... 84/385 R 2,182,198 12/1939 Christensen ..... 84/382

*Primary Examiner*—Lawrence R. Franklin

*Attorney, Agent, or Firm*—Barnes & Thornburg

[57] ABSTRACT

A split E mechanism for flutes having a split G key mechanism is achieved by attaching of a short arm to the F-sharp key in a manner so as to partially overlie an adjacent G-A combination key of the split G key mechanism. According to a preferred embodiment, the arm is soldered to the side of the free end of the F-sharp key at a position such that the adjacent G-A combination key will be closed when the F-sharp key is closed without the G-A combination key interfering with closing of the F-sharp key.

3 Claims, 4 Drawing Figures

SPLIT E FLUTE AND SPLIT E MECHANISM THEREFOR

BACKGROUND OF THE INVENTION

The present invention relates to flutes equipped with a so-called "split E mechanism" (known in Europe simply as an "E mechanism"), and in particular, to an improved split E mechanism for flutes whereby the note E above the staff in treble clef can more easily be played.

The playing of the E above the staff note on the concert flute in C with the acoustical effect of a free blowing note is normally difficult except for very advanced performers. Split E mechanisms have long been known for use in facilitating the playing of this note with the acoustical effect of a free blowing note, however, these mechanisms have not achieved the added benefit of improving the intonation of the second A above the staff note which is notoriously sharp in pitch with a normal key mechanism.

With reference to FIG. 1, it is pointed out that the note E above the staff is played on all flutes by depressing keys 2, 4 and T with the first, second and thumb of the left hand and 8, 9 and 11 with the first, second and fourth fingers of the right hand. On the standard concert flute illustrated in FIG. 1 that is not equipped with a split E mechanism, the offset keys 5 and 6 (also known as a G-A combination key since it is used to play the G note when depressed and an A note when open), are interconnected so that one cannot be displaced independent of the other. On the other hand, in all known flutes equipped with a split E mechanism, the unitary G-A combination key is replaced by a G-A combination known as a split G mechanism which is constructed, in a known manner, so as to enable key 6 to be depressed independently of key 5, but which causes key 6 to be depressed whenever key 5 is.

FIG. 2 depicts part of an American split E key mechanism (designated "A" in FIG. 1);. The mechanism has a hollow tubular section 21 that is mounted upon a shaft so as to be pivotable about the shaft axis X—X. Soldered to one end thereof is a key pad 22 which corresponds to the key 9, and at an opposite end is an actuating arm 23 that is shaped and sized so as to overlie key 6 of the split G mechanism. In this manner, during fingering of the E above the staff note, depression of the key pad 22 results in pivoting of the split E mechanism about the axis X—X so as to result in closing of the key 6.

The above-noted known split E mechanism is typical of the various key arrangements that have been utilized in the past by many makers of flutes, and all of which have been awkward contrivances which not only add unwanted weight to the instrument, but, by their ungainly nature, invite mechanism malfunctions and/or adjustments.

Accordingly, it is an object of the present invention to provide a split E mechanism which achieves the purpose of allowing easy playing of the E above the staff note as well as improving the pitch of the note A above the staff, while virtually eliminating any additional weight or mechanical adjustment difficulties.

Yet another object of the invention is to provide a split E mechanism that will be simpler in construction and less costly to manufacture and install than has heretofore been possible.

BRIEF DESCRIPTION OF THE INVENTION

The above-noted objects are achieved in accordance with a preferred embodiment of the invention by the construction and use of a split E mechanism for flutes having a split G key mechanism that comprises an F-sharp key with a short arm attached thereto that extends from the key in a manner so as to partially overlie an adjacent G-A combination key of the split G mechanism, in use. The mechanism can be simply formed by soldering of a relatively short, straight arm to the F-sharp key so that a padded underside thereof overlies an outer end of the adjacent G-A key.

These and other objects, features and advantages of the present invention will become more apparent from the following description when taken in connection with the accompanying drawing which shows, for purposes of illustration only, a single embodiment in accordance with the present invention, and wherein:

DETAILED DESCRIPTION OF THE PREFERRED EMBODIMENT

Figure 1:
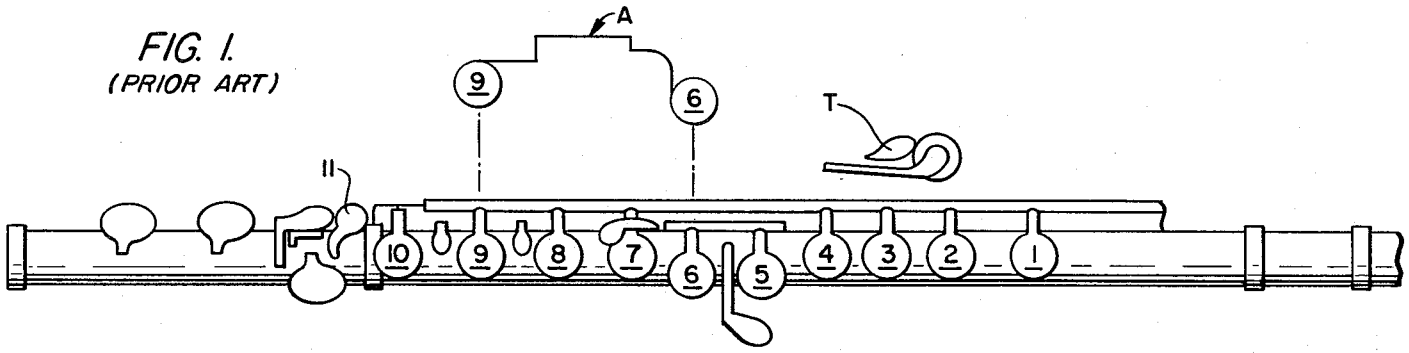
FIG. 1. (PRIOR ART)
FIG. 1 is a schematic illustration of a conventional concert flute with a known split E mechanism schematically illustrated in exploded relation thereto.
Figure 2:
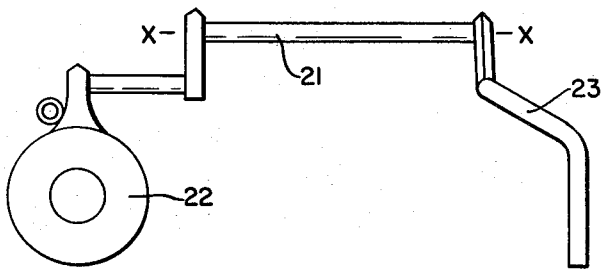
FIG. 2. (PRIOR ART)
FIG. 2 is a perspective view of a known split E mechanism.
Figure 3:
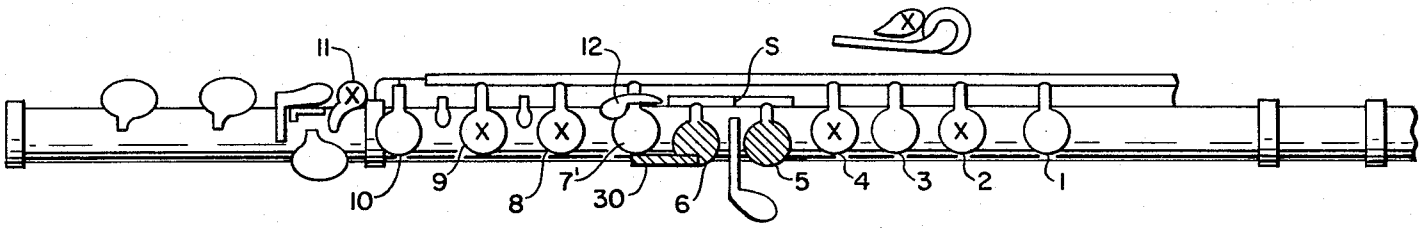
FIG. 3 is a schematic illustration of a flute equipped with a split E mechanism in accordance with the preferred embodiment of the present invention.
Figure 4:
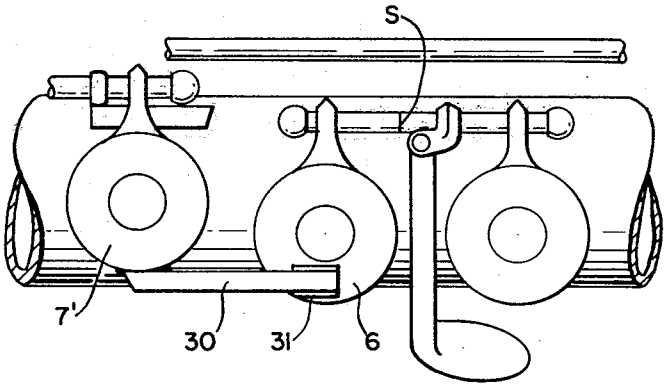
FIG. 4 is a perspective view of a portion of a flute equipped with the E mechanism according to the present invention.

With reference particularly to FIGS. 3 and 4, the nature of the preferred embodiment of the present invention will now be described. In FIG. 3, the keys fingered for playing of the E above the staff are shown with an X marked thereon and correspond to the keys described with reference to FIG. 1. Additionally, the offset G-A combination formed by the split G mechanism (the split being schematically represented in FIG. 3 at S), designated generally as G, keys 5, 6 thereof being shown shaded.

The F-sharp key 7' underlies the B-flat lever 12 as is conventional. It is also noted that the key 7' is not a key that is fingered directly by the musician playing the flute. The key 7' is closed indirectly whenever keys 10, 9 or 8 are closed. One such key which, when fingered, will cause the key 7' to be depressed is the E key 9 which, as noted above, is fingered during playing of the E above the staff note.

It is this key 7' that applicant has utilized to form his split E mechanism C by soldering the short, straight arm 30 to the end thereof. The arm 30 has a pad 31 attached to the underside of the cantilevered free end thereof (only a portion of which is shown exposed in FIG. 4). The arm 30 is of a length and is attached to the key 7' at a position, such that the padded free end thereof overlies the end of the adjacent key 6 of the split G mechanism. In this manner, when the key 7' is caused to swing downward during fingering of the E above the staff note, the arm 30 moves downward therewith a distance sufficient to bring the key 6 down into its closed position. In this regard, while the key 7' is not directly fingered and is only indirectly actuated, applicant has found that sufficient closing force can be transmitted to the key 6 via the arm 30 and that, while the key 6 is offset relative to the key 7' and these keys swing about different pivot axes (their axes being displaced both radially and circumferentially with respect to the body of the flute), an arm 30 placed in an area such as shown in the drawings will move sufficiently downward toward the body of the flute to enable the key 6 to be closed and the overlying relationship between the free end of the arm 30 overlying the key 6 will not be such as to prevent proper closing of the F-sharp key 7' to which the opposite end of the arm 30 is soldered at its side.

Furthermore, since the arm 30 is relatively short (having a length that approximately corresponds to the distances between the lever arm center line of the keys 6, 7'), it adds a negligible amount of weight to the flute, particularly in comparison to the above-described prior art mechanism which, due to its irregular configuration and having to reach to at least beyond key 8, is at least three times the size. Additionally, since the arm 30 is only located at the free ends of the keys 6, 7', it does not require any modification to the other key linkages and mountings or create mechanical adjustment difficulties as is the case with the prior art arrangement. Still further, because of all of these factors, the cost of equipping a flute with the split E mechanism according to the present invention is minimized to a fraction of that required with respect to prior art split E mechanisms.

As a result, it can be seen that the split E mechanism and a flute equipped therewith in accordance with the present invention achieves all of the objects noted at the outset while still achieving the beneficial effects of the split E mechanisms with respect to making it easier to blow an E above staff note and further, contrary to prior known split E mechanisms, improving the intonation of the second A above the staff note.

While I have shown and described only one embodiment in accordance with the present invention, it is understood that the same is not limited thereto but is susceptible of numerous changes and modifications as known to a person skilled in the art and I therefore do not wish to be limited to the details shown and described herein but intend to cover all such changes and modifications as are encompassed by the scope of the appended claims.

I claim:

1. In a flute of the type having a split G key mechanism and a split E mechanism, the improvement wherein said split E mechanism comprises a short arm attached to the F-sharp key and extending therefrom in a manner so as to overlie an adjacent G-A combination key of the split G key mechanism for facilitating the playing of the E above the staff note by causing said G-A key to be closed during normal fingering of said note.

2. A split E mechanism for flutes having a split G key mechanism, comprising an F-sharp key having a short arm attached thereto and extending therefrom in a manner so as to partially overlie an adjacent G-A combination key of the split G key mechanism, in use.

3. A split E mechanism according to claim 1 or 2, wherein said short arm is soldered to the F-sharp key at its side at the free end of the F-sharp key.

* * * * *